United States Patent [19]

Sugioka et al.

[11] Patent Number: 4,779,813

[45] Date of Patent: Oct. 25, 1988

[54] METHOD OF WINDING YARN ON BOBBIN AND MACHINE THEREFOR

[75] Inventors: Takami Sugioka; Yuichi Masaoka, both of Matsuyama, Japan

[73] Assignee: Teijin Seiki Company Limited, Osaka, Japan

[21] Appl. No.: 98,045

[22] Filed: Sep. 17, 1987

[30] Foreign Application Priority Data

Sep. 18, 1986 [JP] Japan ..... 61-221196

[51] Int. Cl.[4] ..... B65H 54/38

[52] U.S. Cl. ..... 242/18.1

[58] Field of Search ..... 242/18.1, 18 R, 43 R

[56] References Cited

U.S. PATENT DOCUMENTS

| | | | |
|---|---|---|---|
| 4,049,211 | 9/1977 | Spescha | 242/18.1 X |
| 4,504,021 | 3/1985 | Schippers et al. | 242/18.1 |
| 4,504,024 | 3/1985 | Gerhartz | 242/18.1 |
| 4,515,320 | 5/1985 | Slavik et al. | 242/18.1 X |
| 4,659,027 | 4/1987 | Schippers et al. | 242/18.1 |
| 4,667,889 | 5/1987 | Gerhartz | 242/18.1 |
| 4,676,441 | 6/1987 | Maag | 242/18.1 |
| 4,696,435 | 9/1987 | Hermanns | 242/18.1 |
| 4,697,753 | 10/1987 | Schippers et al. | 242/18.1 |

FOREIGN PATENT DOCUMENTS

| | | |
|---|---|---|
| 45-41060 | 12/1970 | Japan . |
| 57-33264 | 7/1982 | Japan . |
| 59-43773 | 3/1984 | Japan . |

*Primary Examiner*—Stanley N. Gilreath

*Attorney, Agent, or Firm*—Cushman, Darby & Cushman

[57] ABSTRACT

A method and apparatus for performing the method of winding a yarn on a bobbin holder so as to avoid a ribbonning phenomenon produced during winding, comprising the steps of rotating the bobbin holder; traversing the yarn along an axis of the bobbin holder to form a yarn package on the bobbin holder; setting a ribbon occurrence width and a lower limit value of a yarn winding angle at which the yarn is wound with respect to a vertical plane perpendicular to an axis of rotation of the bobbin holder; calculating an upper limit value of the yarn winding angle from the lower limit value in such a manner that a winding ratio, which is defined as a ratio of the number of rotations of the bobbin holder to the number of yarn traversing strokes, is not within the ribbon occurrence width; and as soon as the winding ratio reaches the lower limit value of the yarn winding angle, increasing rapidly the number of yarn traversing strokes from the lower limit value of the yarn winding angle to the upper limit value, and then decreasing gradually the number of yarn traversing strokes from the upper limit value of the yarn winding angle to the lower limit value with a gradient larger than that of the winding ratio.

4 Claims, 9 Drawing Sheets

METHOD OF WINDING YARN ON BOBBIN AND MACHINE THEREFOR

FIELD OF THE INVENTION

The present invention relates in general to a method of and a machine for winding a continuous yarn or thread on a bobbin, and in particular to an improved method of and machine for winding a continuous yarn or thread on a bobbin which can prevent the occurrence of a so-called ribbonning during the yarn winding operation.

SUMMARY OF THE INVENTION

In accordance with one important aspect of the present invention, there is provided, in a method of winding a yarn on a bobbin holder so as to avoid a ribbonning phenomenon produced during winding, an improvement comprising the steps of rotating the bobbin holder, traversing the yarn along an axis of the bobbin holder to form a yarn package on the bobbin holder, setting and a ribbon occurence width a lower limit value of a yarn winding angle at which the yarn is wound with respect to a vertical plane perpendicular to an axis of rotation of the bobbin holder; calculating an upper limit value of the yarn winding angle from the lower limit value in such a manner that a winding ratio, which is defined as a ratio of the number of rotations of the bobbin holder to the number of yarn traversing strokes, is not within the ribbon occurrence width; and as soon as the winding ratio reaches said lower limit value of said winding angle, the number of yarn traversing strokes is increased rapidly from the lower limit value of the yarn winding angle to the upper limit value, and the number of yarn traversing strokes is then decreased gradually from the upper limit value of the yarn winding angle to the lower limit value with a gradient larger than that of the winding ratio.

In accordance with another important aspect of the present invention, there is provided a machine for winding a yarn, comprising a bobbin holder on which the yarn is wound into a yarn package; means for rotating the bobbin holder to wind the yard thereon; a traversing mechanism for traversing the yarn along an axis of rotation of the bobbin holder; setting means for setting a ribbon occurence width a lower limit value of a yarn winding angle at which the yarn is wound with respect to a vertical plane perpendicular to the axis of rotation of the bobbin holder, and a traverse stroke of the yarn; first detecting means for detecting a winding speed of the yarn; gradient operation means for calculating the number of rotation of the the bobbin holder from the lower limit value of the yarn winding angle, the traverse stroke and the winding speed of the yarn, for calculating an upper limit value of the yarn winding angle from the lower limit value of the yarn winding angle so that a winding ratio, which is defined as a ratio if the number of rotations of the bobbin holder to the number of yarn traversing strokes, is not within the ribbon occurrence width, for calculating the number of yarn traversing strokes from the upper limit value of the yarn winding angle, the traverse stroke and the winding speed, and for calculating a gradient of traverse from the number of yarn traversing strokes and the number of rotations of the bobbin holder, and for rapidly increasing the number of yarn traversing strokes from the lower limit value of the winding angle to the upper limit value, as soon as the winding ratio reaches the lower limit value, and then gradually decreasing the number of yarn traversing strokes from the upper limit value of the yarn winding angle to the lower limit value of the yarn winding angle with the gradient of traverse larger than that of the winding ratio; second detecting means for detecting the number of rotations of the bobbin holder; and traverse operation means for calculating the number of yarn traversing strokes in accordance with the gradient of calculated by the gradient operation means, the number of rotations of the bobbin holder calculated by the gradient operation means, and the number of rotations of the bobbin holder detected by the second detecting means, the yarn being traversed by the traversing mechanism in accordance with the number of yarn traversing strokes calculated by the traverse operation means.

DESCRIPTION OF THE PRIOR ART

In winding a continuous yarn or thread on a bobbin holder at high speeds and forming a yarn package on the bobbin holder, the yarn is generally traversed alternately in opposite directions parallel with the axis of rotation of the bobbin holder at a constant winding angle with respect to a vertical plane perpendicular to an axis of rotation of the bobbin holder. In this case, when a ratio of the number of rotations of the bobbin holder to the number of yarn traversing strokes (hereinafter referred to as a "winding ratio") is an integral number, the yarn tends to be wound on a turn of the yarn previously wound on the bobbin, thereby making the outer circumferential surface of the yarn package uneven and forming circumferential rib portions on the yarn package (called "ribbonning"). Such a ribbonning phenomenon may cause the outer circumferential layer of the yarn package to slide to form rib portions or vibration during the yarn winding operation. If the vibration is caused by the ribbonning phenomenon, the yarn tends to be dropped from the layer of the circumferential rib portion formed previous to the rib portion now being formed.

In order to avoid the aforementioned disadvantages, a yarn winding machine of the step type has been proposed in Japanese patent publication No. 57-33264. In this machine, the aforementioned winding ratio is varied in steps to prevent an occurrence of the aforementioned ribbonning during the yarn winding operation. The conventional yarn winding machine of the step type, however, still has the following disadvantages:

(I) Since an actual diameter of the yarn package wound on the bobbin holder differs from a yarn package diameter calculated from the number of rotations of the bobbin holder due to the contact pressure applied between the package and the contact roller held in rolling engagement with the package and due to the rib portions at the axial opposite ends of the package, there are fluctuations of the winding ratio.

(II) Since the number of yarn traversing strokes is calculated by detecting the number of rotations of the bobbin holder and multiplying the detected value by the winding ratio, there is a delay of time between the calculation and the operation. Because of the delay of time, even if a winding ratio is set which prevents an occurrence of the ribbonning, the ribbonning will occur if the winding ratio is set in the vicinity of an integral number.

In order to prevent the aforementioned disadvantages (I) and (II), the following three methods have been proposed in Japanese patent laid-open publication No.

59-43773, Japanese patent publication No. 57-33264 and Japanese patent publication No. 45-41060, respectively.

In the method disclosed in the Japanese patent laid-open publication No. 59-43773, when the winding ratio approaches an integral number, the number of yarn traversing strokes is rapidly changed from the lower limit value thereof to the upper limit value thereof and then rapidly from the upper limit value to the lower limit value. However, as shown in FIG. 16, when the number of yarn traversing strokes is rapidly changed from the lower limit value to the upper limit value, the yarn winding angle is increased, thereby resulting in a decrease in the width H of a yarn package 30. When, on the other hand, the number of yarn traversing strokes is rapidly changed from the upper limit value to the lower limit value, the yarn winding angle is decreased, thereby resulting in an increase in the width H of the yarn package 30. In the case of a fine yarn less than 150 denier, there is the disadvantage that the yarn drops from the end faces of the yarn package.

In the method disclosed in the Japanese patent publication No. 57-33264, the number of rotations of the bobbin holder and the number of yarn traversing strokes are detected during the yarn winding operation, and the number of yarn traversing strokes is controlled so that the winding ratio is maintained constant. However, since an actual diameter of the yarn package wound on the bobbin holder differs from a yarn package diameter calculated from the number of rotations of the bobbin holder due to the contact pressure applied between the package and the contact roller and due to the rib portions at the axial opposite ends of the package, there are fluctuations of the winding ratio. Furthermore, since the number of yarn traversing strokes is calculated by detecting the number of rotations of the bobbin holder and multiplying the detected value by the winding ratio, there is a delay of time between the calculation and the operation. Because of the delay of time, even if a winding ratio is set which prevents an occurrence of the ribbonning, the ribbonning will occur if the winding ratio is set in the vicinity of an integral number, $\frac{1}{2}$, $\frac{1}{3}$, $\frac{1}{4}$, and 1/5.

In the method disclosed in the Japanese patent publication No. 45-41060, the yarn is wound with the lower limit value of the number of yarn traversing strokes, and when the winding ratio approaches an integral number, the number of yarn traversing strokes is rapidly increased to the upper limit value and then decreased therefrom in accordance with the winding ratio which prevents an occurrence of ribbonning. Therefore, as in the aforementioned case, the ribbonning occurs due to the delay of time and the difference between the actual package diameter and the calculated package diameter. Furthermore, even if the number of yarn traversing strokes is not rapidly decreased from the upper limit value to the lower limit value after it is increased to the upper limit value, the ribbonning will occur if the number of yarn traversing strokes is decreased with a gradient smaller than that of the winding ratio (the number of rotations of the bobbin holder/the number of yarn traversing strokes=constant).

From the aforementioned disadvantages in the prior art, the inventors of this application have found the fact that the ribbonning occurs when the yarn winding angle is changed from the upper limit value thereof to the lower limit value thereof.

It is, accordingly, an object of the present invention to prevent an improved method of and machine for winding yarn on a bobbin holder which provide an occurrence of ribbonning by changing the number of yarn traversing strokes gradually when the upper limit value of the yarn winding angle is changed to the lower limit value of the yarn winding angle.

BRIEF DESCRIPTION OF THE DRAWINGS

The drawbacks of a conventional yarn winding machine and the features and advantages of a yarn winding machine according to the present invention will be more clearly understood from the following description taken in conjunction with the accompanying drawings in which.

DESCRIPTION OF THE PREFERRED EMBODIMENTS

Figure 1:
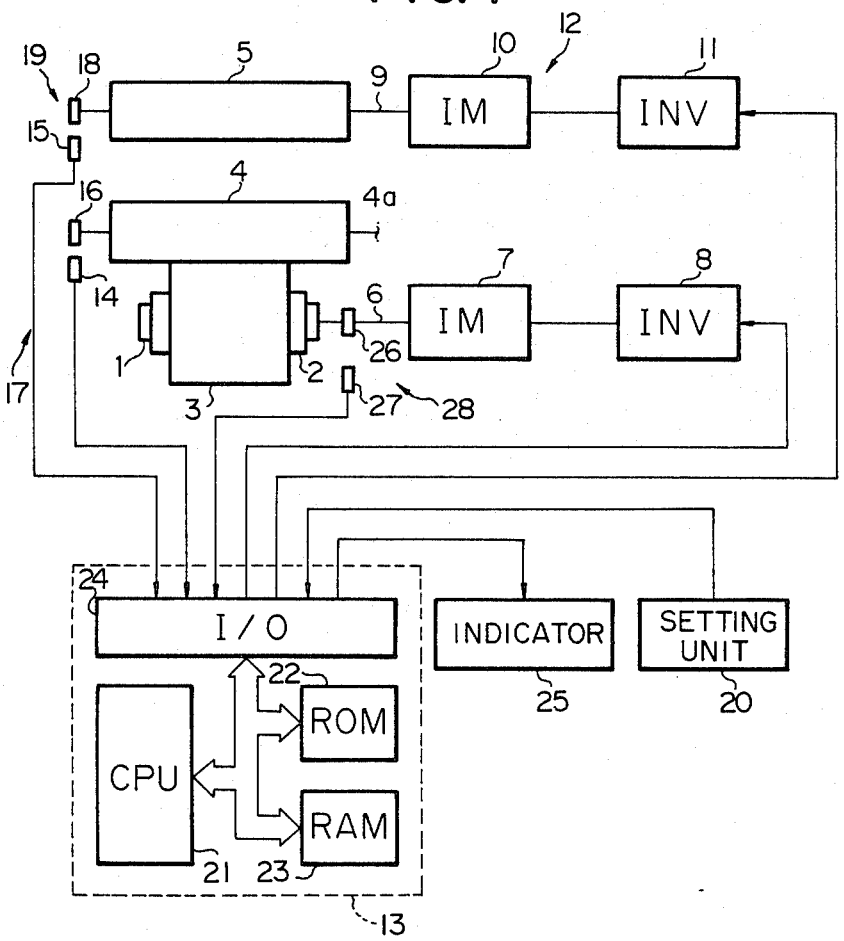
FIG. 1 is a diagrammatic view of one embodiment of the yarn winding machine according to the present invention.

Referring now to FIG. 1 of the drawings, a bobbin holder designated by reference numeral 1 has a cylindrical bobbin 2 mounted thereon so that the bobbin 2 rotates therewith. The bobbin 2 has a continuous yarn or thread wound thereon into a suitable form of yarn package 3. In parallel with the bobbin 2 is provided a contact roller 4 rotatable on a shaft 4*a*. During the yarn winding operation, the yarn package 3 on the bobbin 2 is held in rolling contact with the contact roller 4. The yarn to be wound on the bobbin 2 is fed through a yarn traversing cam 5 which traverses the yarn alternately in opposite directions parallel with the axis of rotation of the bobbin 2 so that the yarn is distributed uniformally throughout the length of the yarn package 3.

The bobbin holder 1 of the bobbin 2 is connected through a drive shaft 6 to an induction motor 7 so as to be driven for rotation. The induction motor 7 rotates with the frequency corresponding to the output of an inverter 8 and drives the bobbin holder 1. The yarn traversing cam 5 is connected through a drive shaft 9 to an induction motor 10 so as to be driven for rotation. The induction motor 10 rotates with the frequency corresponding to the output of an inverter 11 and drives the yarn traversing cam 5. The aforementioned yarn traversing cam 5, drive shaft 9, induction motor 10 and inverter 11 as a whole constitute a traversing mechanism indicated generally by reference numeral 12.

The output of each of the inverters 8 and 11 is controlled in accordance with a command signal from a controller unit 13 to which signals from first and second electromagnetic pickups 14 and 15 are inputted. The first electromagnetic pickup 14 is disposed adjacent a gear 16 fixed on the shaft 4*a* of the contact roller 4 to detect the number of rotations of the gear 16. As a result, the number of rotations $N_c$ of the contact roller 4 is detected indirectly from the number of rotations of the gear 16. The first electromagnetic pickup 14 and gear 16 of the contact roller 4 as a whole constitute first detecting means 17 for detecting a winding speed of the yarn. The second electromagnetic pickup 15 is disposed adjacent a gear 18 fixed on the drive shaft 9 of the yarn traversing cam 5 to detect the number of rotations of the gear 18. As a result, the number of rotations $N_t$ of the yarn traversing cam 5 is detected indirectly from the number of rotations of the gear 18. The second electromagnetic pickup 15 and gear 18 of the yarn traversing cam 5 as a whole constitute second detecting means 19 for detecting the number of rotations $N_t$ of the yarn traversing cam 5. A third electromagnetic pickup 27 is disposed adjacent a gear 26 fixed on the drive shaft 6 of the bobbin holder 1 to detect the number of rotations $N_b$ of the bobbin holder 1. The third electromagnetic pickup 27 and gear 26 of the drive shaft 6 as a whole constitute third detecting means 28 for detecting the number of rotations $N_b$ of the bobbin holder 1.

To the controller unit 13 is inputted a signal from a setting unit (setting means) 20 which is adapted to set a lower limit value $\theta_L$ of a yarn winding angle at which the yarn is wound with respect to a vertical plane perpendicular to the axis of rotation of the bobbin 2, a traverse stroke S of the yarn package 3 to be wound on the bobbin 2, a ribbon occurrence width Y and a ribbon occurrence width Z. These values may be set manually by an operator or automatically by the setting unit 20 in accordance with information from the controller unit 13. It is noted that if the aforementioned winding ratio (=the number of rotations of the bobbin holder/the number of yarn traversing strokes) is within the ribbon occurrence width, a so-called ribbonning phenomenon (which makes the outer circumferential surface of the yarn package uneven) occurs.

The controller unit 13 has gradient operation means for calculating a gradient of the number of yarn traversing strokes, and traverse operation means for calculating the number of yarn traversing strokes in accordance with the gradient calculated by the gradient operation means. The controller unit 13 comprises a central processing unit 21 labelled as "CPU", a read-only memory 22 labelled as "ROM", a random access memory 23 labelled as "RAM" and an input-output port 24 labelled as "I/O". The CPU 21 receives external data which are necessary for the programs read in the ROM 22, and processes values necessary for a yarn traversing control, giving and receiving data between the CPU 21 and the RAM 23. The processed values are delivered from the CPU 21 to the I/O port 24. The I/O port 24 receives signals from the electromagnetic pickups 14, 15 and 27 and a signal from the setting unit 20, and delivers command signals to the inverters 8 and 11 and an indication signal $S_H$ to an indicator 25. The ROM 22 has stored therein programs and datum which are to be processed in the CPU 21. The RAM 23 temporarily memorizes external information and data to be used in operation. The indicator 25 indicates information necessary for a winding control in accordance with the signal $S_H$ delivered from the controller unit 13.

Figure 2:
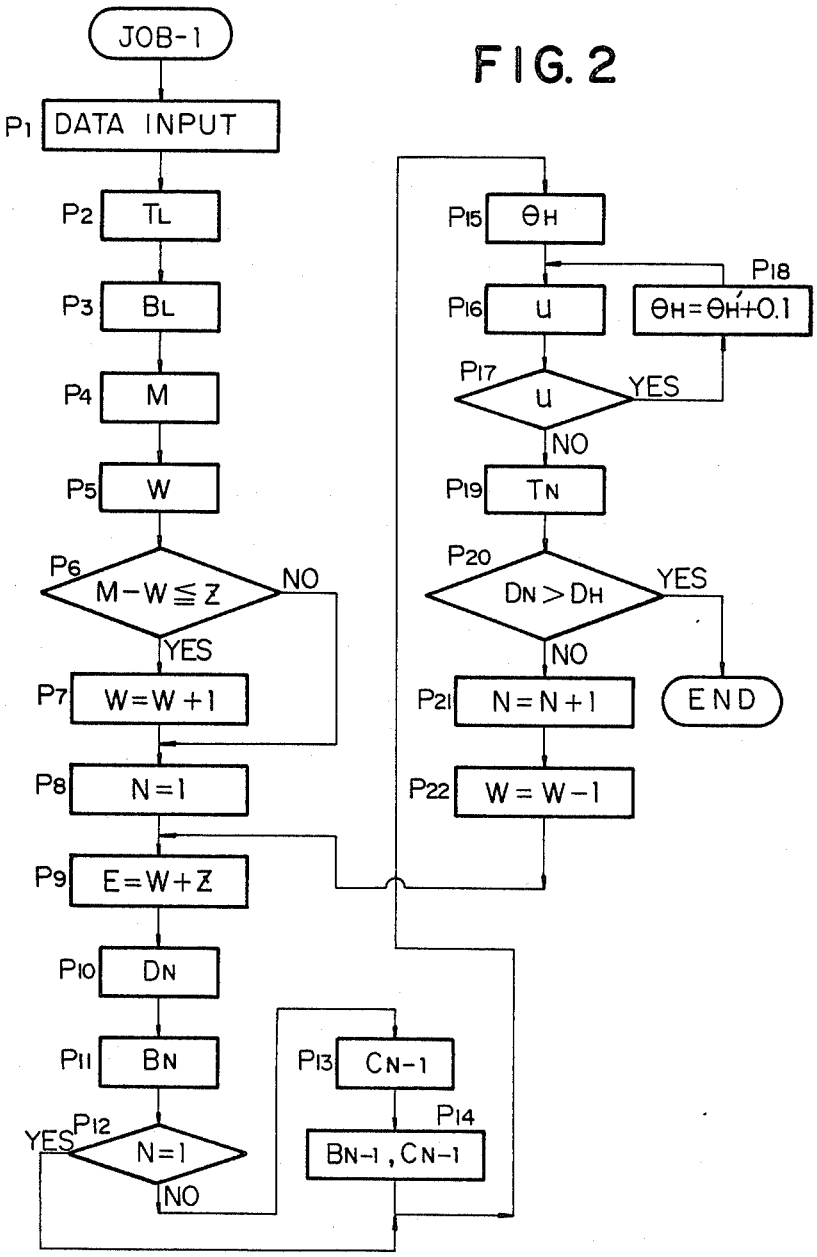
FIG. 2 is a flow diagram representing the essential steps in a preferred method of carrying out the present invention.
Figure 4:
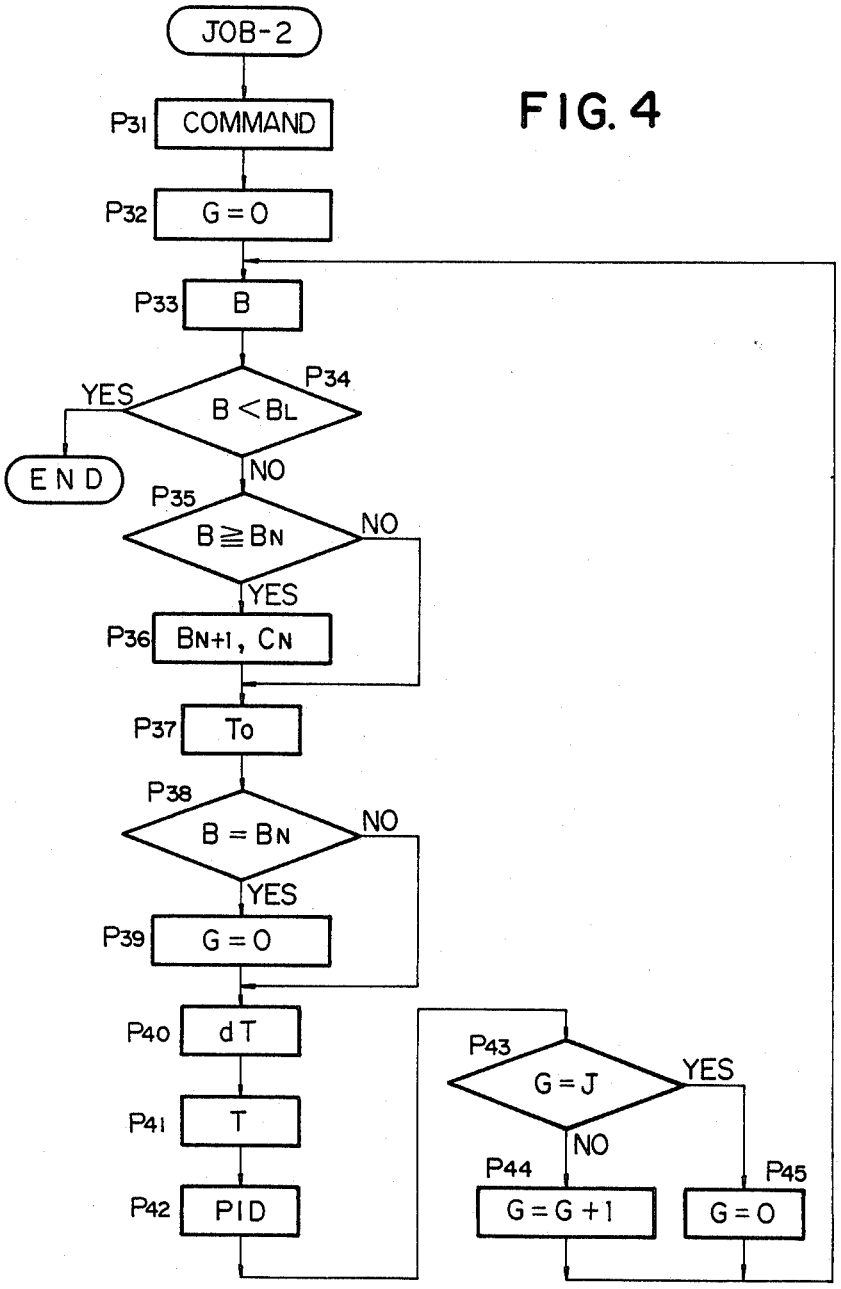
FIG. 4 is a flow diagram representing the essential steps for calculating the number of yarn traversing strokes during the yarn winding operation.

FIGS. 2 and 4 are flow diagrams for the yarn traversing control program. The yarn traversing control program according to the present invention consists of a first program indicated by "JOB-1" in FIG. 2 for calculating a locus ofthe number of yarn traversing strokes which prevents an occurrence of the so-called ribbonning phenomenon, and a second program indicated by "JOB-2" in FIG. 4 for calculating the number of yarn traversing strokes during the winding operation. The first program JOB-1 and the second program JOB-2 are processed in the recited order.

At a step $P_1$ in the program JOB-1 shown in FIG. 2, a yarn winding speed V, a yarn traverse stroke S, a lower limit value $\theta_L$ of the yarn winding angle, a ribbon occurrence width Y and a ribbon occurrence width Z are inputted to the setting unit 20. It is desirable that the ribbon occurrence widths Y and Z be between 0.05 and 0.2. At a step $P_2$, the number of yarn traversing strokes $T_L$ when the yarn winding angle is the lower limit value $\theta_L$ is calculated in accordance with the following equation (1):

$$T_L = V \tan \theta_L / 2\,S \qquad (1).$$

At a step $P_3$, the number of rotations $B_L$ of the bobbin holder 1 is calculated when the yarn package 3 on the bobbin 2 has the maximum diameter. At a step $P_4$, when the yarn is not wound on the bobbin 2, that is, when the diameter of the bobbin 2 is $D_M$ (see the point 3 indicated in FIG. 3), a winding ratio M is calculated in accordance with the following equation (2):

$$M = 4\,S/(\pi D_M \tan \theta_L) \qquad (2).$$

Figure 3:
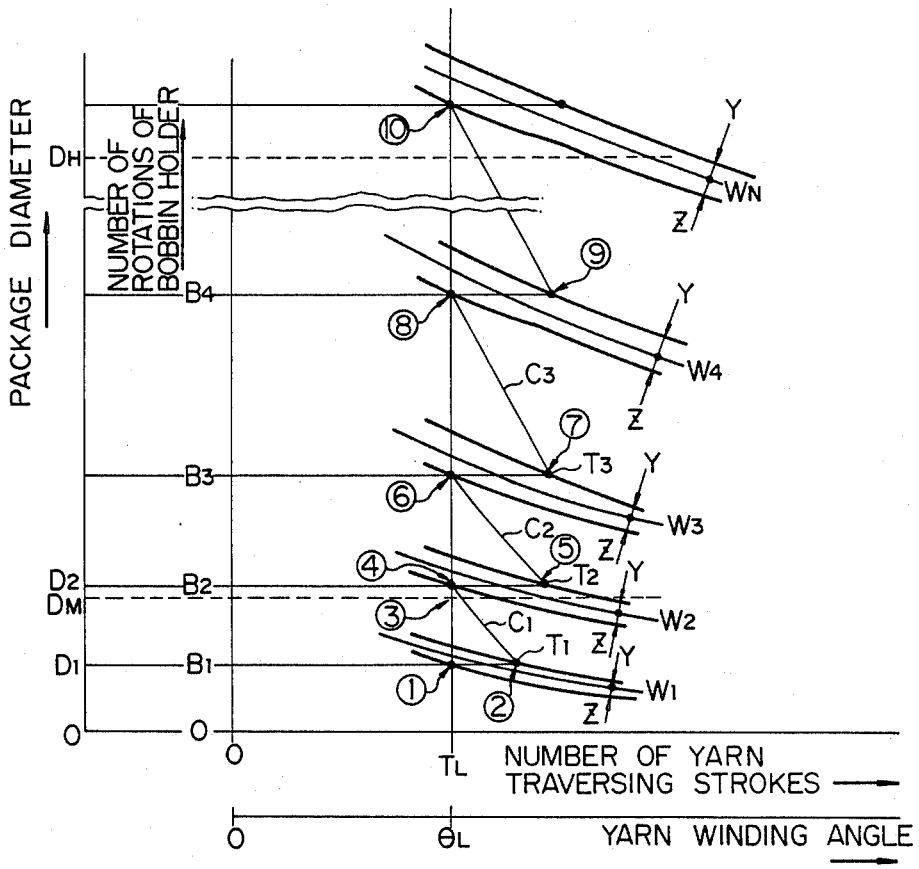
FIG. 3 shows a locus of the number of yarn traversing strokes obtained in accordance with the flow diagram shown in FIG. 2.

At a step $P_5$, the winding ratio M calculated at the step $P_4$ is made an integral number W (that is, a winding ratio $W_2$ indicated in FIG. 3 is calculated). In this embodiment, the winding ratio M is made an integral number by omitting fractions. It is noted that the winding ratio M may also be made an integral number by raising to a unit or counting fractions of 0.5 and over as an integral number. Although the winding ratio M is intended to mean that M=the number of rotations of the bobbin holder/the number of yarn traversing strokes, in this embodiment the winding ratio M is doubled, and 50% of 2M is also avoided. At a step $P_6$, it is determined whether the winding ratio M at the point 3 of FIG. 3 is within the ribbon occurrence width Z of the winding ratio W or not. When (M−W) is not more than the Z, the winding ratio M is determined to be not within the ribbon occurrence width Z, and at a step $P_7$, one is added to the winding ratio W obtained at the step $P_5$. That is, the winding ratio $W_1$ is obtained. When, on the other hand, (M−W) is more than the Z, the winding ratio M is determined to be within the ribbon occurrence width Z, and the step $P_6$ advances directly to a step $P_8$ without passing through the step $P_7$. In this embodiment, the aforementioned winding ratio M is not within the ribbon occurrence width Z. Therefore, at the step $P_8$, a count value N is set as N=1. At a step $P_9$, a winding ratio E at the point 1 indicated in FIG. 3 is obtained by adding the ribbon occurrence width Z to the winding ratio W obtained at the step $P_5$. At a step $P_{10}$, a package diameter $D_1$ when the winding ratio is E is calculated in accordance with the following equation (3):

$$D_N=4S/(\pi E \tan \theta_L) \quad (3).$$

At a step $P_{11}$, when the package diameter is $D_1$, the number of rotations $B_1$ of the bobbin holder 1 is calculated in accordance with the following equation (4):

$$B_N=V/\pi D_N \quad (4).$$

It is noted that the package diameter $D_1$ at the point 1 of FIG. 3 is smaller than the diameter $D_M$ of an empty bobbin but is called a package diameter for convenience' sake. At a step $P_{12}$, the count value N is compared with one. When the count value N is equal to one, the step $P_{12}$ advances directly to a step $P_{15}$ without passing through steps $P_{13}$ and $P_{14}$. When the count value N is not equal to one, the step $P_{12}$ advances to the step $P_{13}$. Since the count value N is one at the step $P_8$, a yarn winding angle $\theta_H$ is obtained at the step $P_{15}$ by adding 0.1° to the lower limit value $\theta_L$ of the yarn winding angle inputted at the step $P_1$. At a step $P_{16}$, a winding ratio u when the yarn winding angle is $\theta_H$ is calculated in accordance with the following equation (5):

$$u=4S/(\pi D_N \tan \theta_H) \quad (5).$$

At a step $P_{17}$, the winding ratio u is compared with $(W_1+Z)$ and $(W_1-Y)$. When the winding ratio u is between $(W_1+Z)$ and $(W_1-Y)$, a new yarn winding angle $\theta_H$ is calculated at a step $P_{18}$ in accordance with the following equation (6):

$$\theta_H=\theta_H'+0.1 \quad (6);$$

wherein the $\theta_H'$ indicates the last value of $\theta_H$. The step $P_{18}$ returns back to the step $P_{16}$, and as a result, the yarn winding angle $\theta_H$ is increased 0.1° by 0.1° until the winding ratio u becomes outside the predetermined width between $(W_1+Z)$ and $(W_1-Y)$. When the winding ratio u is not between $(W_1+Z)$ and $(W_1-Y)$, the step $P_{17}$ advances to a step $P_{19}$. At the step $P_{19}$, the number of yarn traversing strokes $T_1$ when the yarn winding angle at the point 2 of FIG. 3 is $\theta_H$ is calculated in accordance with the following equation (7):

$$T_N=V \tan \theta_H/2 \quad (7).$$

At a step $P_{20}$, the diameter $D_N$ of the bobbin is compared with the maximum diameter $D_H$ of the winding machine. Since the count value N is one, the diameter $D_1$ of the bobbin at the point 2 of FIG. 3 is compared with the maximum diameter $D_H$ of the winding machine. When the diameter $D_N$ is less than the maximum diameter $D_H$, one is added to the count value N at a step $P_{21}$. At a step $P_{22}$, one is subtracted from the winding ratio W obtained at the step $P_5$. The step $P_{22}$ returns back to the step $P_9$ to calculate a winding ratio E of the point 4 indicated in FIG. 3 by adding the ribbon occurrence width Z to the winding ratio $W_1$. At the step $P_{10}$, a package diameter $D_2$ of the point 3 is calculated in accordance with the aforementioned equation (3). At the step $P_{11}$, the number of rotations $B_2$ of the bobbin holder 1 is calculated in accordance with the aforementioned equation (4). At the step $P_{12}$, the count value N is compared with one. Since the count value N is two, a descending gradient $C_1$ between the points 2 and 4 of FIG. 3 is calculated at the step $P_{13}$ in accordance with the following equation (8);

$$C_{N-1}=(T_{N-1}31\ T_L)/(B_{N-1}-B_N) \quad (8),$$

wherein the $C_{N-1}$ indicates a descending gradient, the $T_L$ indicates a lower limit value of the number of yarn traversing strokes, the $B_{N-1}$ indicates the number of rotations of the bobbin holder calculated last time, the $T_{N-1}$ indicates the number of yarn traversing strokes calculated last time and the $B_N$ indicates the number of rotations of the bobbin holder calculated this time. At the step $P_{14}$, the $B_{N-1}$ and the $C_{N-1}$ are memorized in the RAM 23. When the count value is two, the $B_1$ and $C_1$ are memorized in the RAM 23. At the step $P_{15}$, a yarn winding angle $\theta_H$ is obtained by adding 0.1° to the lower limit value $\theta_L$ of the yarn winding angle. At the step $P_{16}$, a winding ratio u when the yarn winding angle is $\theta_H$ is calculated in accordance with the aforementioned equation (5). The steps $P_{17}$, $P_{18}$ and $P_{16}$ are repeated, and when the winding ratio u is not between $(W_N+Z)$ and $(W_N-Y)$, the number of yarn traversing strokes $T_2$ when the yarn winding angle of the point 5 of FIG. 3 is $\theta_H$ is calculated at the step $P_{19}$ in accordance with the aforementioned equation (7). The number of yarn traversing strokes $T_N$ and the gradient $C_{N-1}$ at the points 6, 7, 8, 9 and 10 of FIG. 3 are calculated by repeating the aforementioned steps $P_9$ through $P_{22}$. When the diameter $D_N$ is more than the maximum diameter $D_H$, the aforementioned first program JOB-1 ends and then the second program JOB-2 starts.

After the first program JOB-1 ends, the bobbin holder 1 and the traversing mechanism 12 are actuated by a command of actuation of the winding machine, and when the number of yarn traversing strokes reaches a predetermined value (in this embodiment, a lower limit value $T_L$), the second program JOB-2 shown in FIG. 4 starts at a step $P_{31}$ by a command of operation. When the winding machine is started, a value G is set as G=0 at a step $P_{32}$. At a step $P_{33}$, the number of rotations B of the bobbin holder 1 is picked up every predetermined cycle, and at a step $P_{34}$, the number of rotations B is compared with the number of rotations $B_L$ when the diameter of the package 3 on the bobbin 2 is the maximum $D_H$. While data have been read out in accordance with the number of rotations B of the bobbin holder 1, it is noted that they may also be read out in accordance with the diameter of the yarn package 3 on the bobbin 2. When the B is not less than the $B_L$, the number of rotations B of the bobbin holder 1 picked up at the step $P_{33}$ is compared at a step $P_{35}$ with the number of rotations $B_N$ of the bobbin holder 1 calculated in the first program JOB-1. When the B is not less than the $B_N$, the $B_{N+1}$ and $C_N$ calculated and memorized in the first program JOB-1 are read out at a step $P_{36}$. When, on the other hand, the B is less than the $B_N$, the step $P_{35}$ advances directly to a step $P_{37}$ without passing through the step $P_{36}$. At the step $P_{37}$, the number of yarn traversing strokes $T_0$ is calculated in accordance with the following equation (9):

$$T_0 = C_N(B_{N+1} - B) + T_L \quad (9),$$

Figure 5:
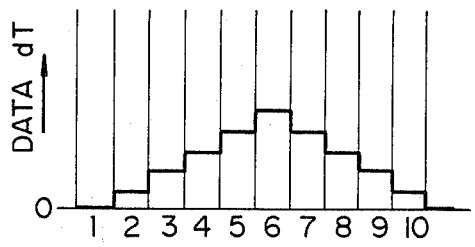
FIG. 5 shows a pattern by which the number of yarn traversing strokes is increased and decreased with a predetermined cycle.
Figure 6:
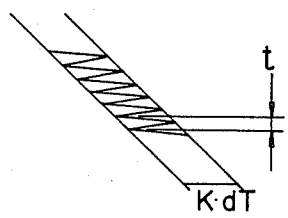
FIG. 6 shows the number of yarn traversing strokes obtained in accordance with the flow diagrams shown in FIGS. 2 and 4.
Figure 7:
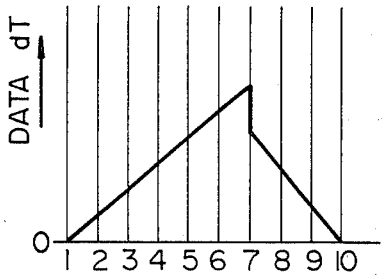
FIG. 7 shows another pattern by which the number of yarn traversing strokes is increased and decreased with a predetermined cycle.
Figure 8:
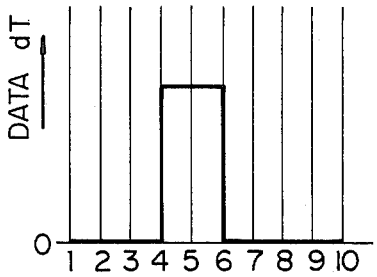
FIG. 8 shows yet another pattern by which the number of yarn traversing strokes is increased and decreased with a predetermined cycle.

At a step $P_{38}$, the number of rotations B of the bobbin holder picked up at the step $P_{33}$ is compared with the number of rotations $B_N$ of the bobbin holder, and when the B is equal to the $B_N$, the value G is set as G=0 at a step $P_{39}$. When the B is not equal to the $B_N$, the step $P_{38}$ advances to a step $P_{40}$ without passing through the step $P_{39}$. At the step $P_{40}$, a data dT corresponding to G=0 is read out from the memory stored in advance as shown in FIG. 5, and at a step $P_{41}$, a reference value T is calculated in accordance with the following equation (10):

$$T = K\,(T_0 + d_T) \quad (10),$$

wherein the T indicates a reference value for comparing with the number of yarn traversing strokes detected at the pickup 15, the K indicates a constant determined by the number of turns of the cam, the number of teeth of the gear 8, etc., the $T_0$ indicates the number of yarn traversing strokes calculated at the step $P_{37}$, and the dT indicates a value for increasing and decreasing the number of yarn traversing strokes by a predetermined amount with a predetermined cycle. At a step $P_{42}$, the reference value T is compared with the number of yarn traversing strokes detected at the pickup 15, and according to the difference between the two, the frequency of the inverter 11, which supples electric power to the motor 10, is controlled by a so-called PID control. At a step $P_{43}$, the value G is compared with a value J inputted in advance. When the value G is not equal to the value J, one is added to the value G at a step $P_{44}$, and the step $P_{44}$ returns back to the step $P_{33}$. When the value G is equal to the value J, the value G is set as G=0 at a step $P_{45}$, and the step $P_{45}$ returns back to the step $P_{33}$ to repeat the step $P_{33}$ through the step $P_{44}$. When, on the other hand, the number of rotations B of the bobbin holder picked up at the step $P_{33}$ is less than the number of rotations $B_L$ when the diameter of the package on the bobbin is the maximum $D_H$, that is, when the diameter of the package exceeds the maximum diameter $D_H$, the second program JOB-2 ends. If the aforementioned each step is processed repeatedly, the number of yarn traversing strokes can be obtained which varies with an amplitude of (K·dT) and a cycle of t as shown in FIG. 6. The magnitude of the amplitude (K·dT) is determined by the magnitude of the data dT, and the magnitude of the cycle t is determined by the magnitude of the value J. It is desirable that the amplitude (K·dT) be between 0.5% and 8% of the $T_L$ and that the cycle t be between 0.5 sec. and 4 sec. While the pattern of dT has been shown in FIG. 5, it is noted that the patterns as shown in FIGS. 7 and 8 may also be used in accordance with operating conditions.

The effect of the present invention will be hereinafter explained.

The winding ratio of an integral number is provided with a predetermined bobbin occurrence width, and if the number of yarn traversing strokes approaches the winding ratio, it is rapidly increased to avoid the bobbin occurrence width of the winding ratio, and then decreased with a gradient larger than that of the winding ratio (the number of rotations of the bobbin holder/the number of yarn traversing strokes=a constant gradient). Therefore, in decreasing the number of yarn traversing strokes, the yarn can be prevented from dropping from the yarn package. In addition, since the yarn winding angle is gradually increased very little by very little the difference between the upper and lower limit values of the yarn winding angle can be made small, and therefore, the irregularities of the lateral end faces of the packages can be made small. In addition, in the case that the difference between the upper and lower limit values of the yarn winding angle is the same from the beginning of the winding operation to the end, the effect of the present invention can also be achieved.

Figure 9:
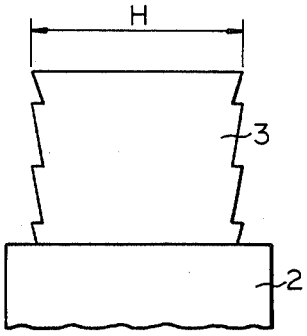
FIG. 9 is a cross-sectional view showing a yarn package formed in accordance with the present invention.
Figure 16:
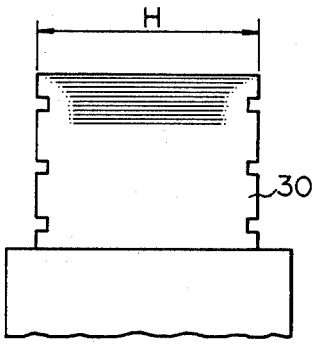
FIG. 16 PRIOR ART
FIG. 16 is a cross-sectional view showing an undesirable yarn package wound on a bobbin holder by a conventional yarn winding machine.

Since the number of yarn traversing strokes is varied with a short cycle and a small amplitude as shown in FIG. 6, an occurrence of the ribbonning phenomenon can be completely as shown in FIG. 9, and also an undesirable package as shown in FIG. 16 can be prevented, thereby enhancing the quality of finished products.

Furthermore, since predetermined data which avoid the occurrence of ribbonning are inputted in advance before the yarn winding machine is operated, the occurrence of ribbonning can be effectively prevented. In the case that a yarn traversing stroke is required to be varied depending upon various kinds of brands in response to the requirement of FMS (Flexible Manufacturing System), the yarn traversing stroke can be easily varied in accordance with the present invention.

While the number of yarn traversing strokes has been controlled by memorizing a pattern in the ROM 22, it is noted that it may also be controlled by a function memorized in advance in the ROM 22.

Figure 10:
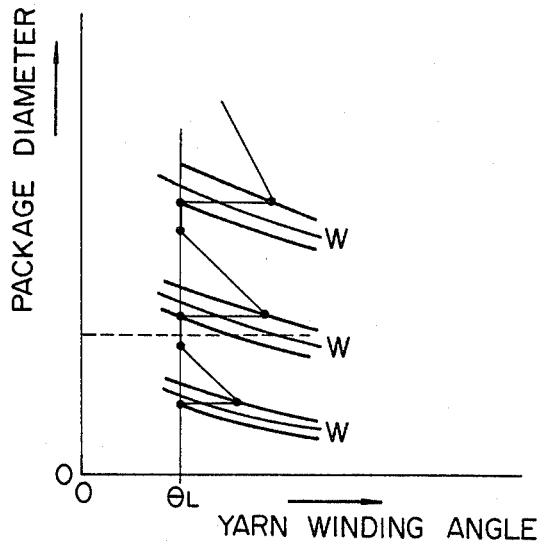
FIG. 10 shows a locus of the number of yarn traversing strokes obtained in accordance with another embodiment of the present invention.
Figure 11:
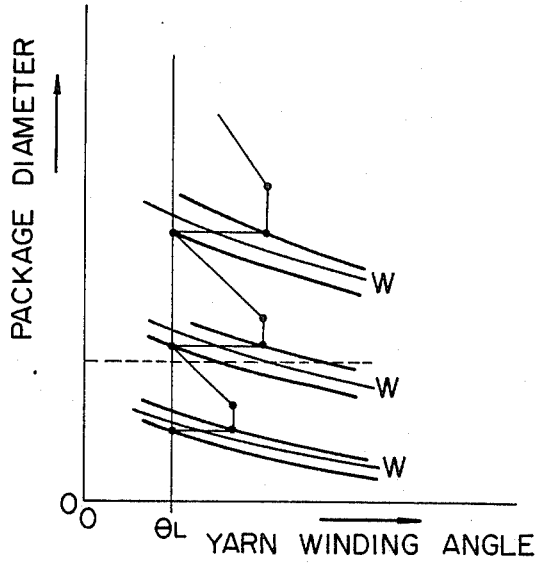
FIG. 11 shows a locus of the number of yarn traversing strokes obtained in accordance with yet another embodiment of the present invention.

In addition, while the number of yarn traversing strokes has been decreased from the ribbon occurrence width of the upper limit of the yarn winding angle to the ribbon occurrence width of the lower limit with a predetermined gradient, it is noted that it may also be decreased with a gradient crossing the gradient of the winding ratio. For example, the effect of the present invention can be achieved by a locus of the number of yarn traversing strokes as shown in FIG. 10 and a locus of the number of yarn traversing strokes as shown in FIG. 11.

In addition, while the number of yarn traversing strokes has been decreased with the gradient calculated in accordance with the equation $C_{N-1} = (T_{N-1} - T_L)/(B_{N-1} - B_N)$, it is noted that it may also be decreased with a gradient which exceeds a gradient of the winding ratio. For example, the upper and lower limit values of the winding ratio are inputted in advance, and the number of yarn traversing strokes is decreased between the upper and lower limit values with a predetermined gradient larger than that of the winding ratio.

Figure 12:
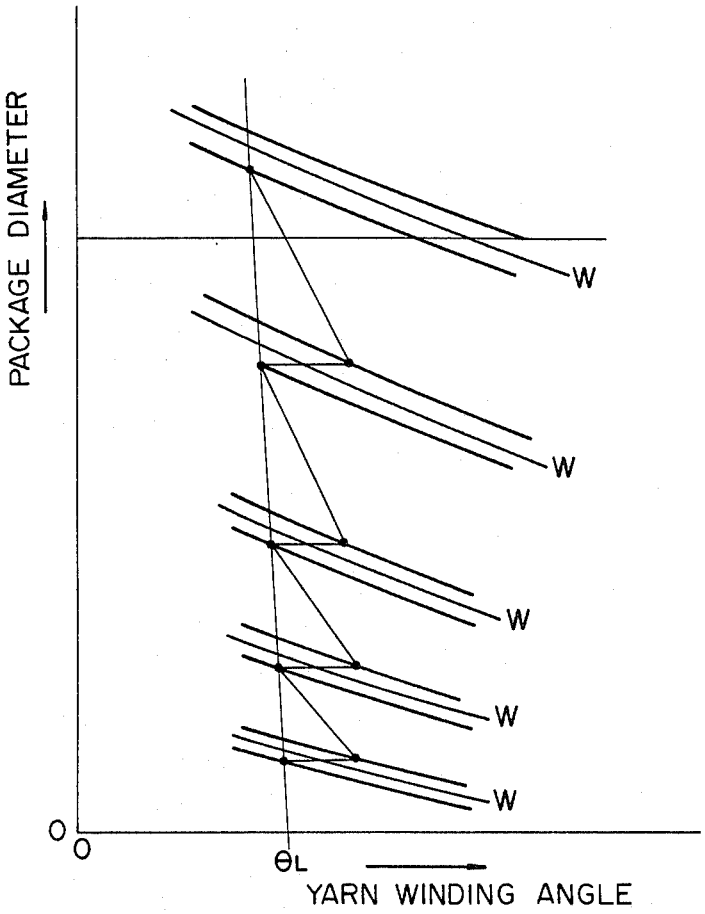
FIG. 12 shows a locus of the number of yarn traversing strokes obtained in accordance with another embodiment of the present invention, the lower limit value of the number of yarn traversing strokes being changed while the upper limit value is maintained constant.
Figure 13:
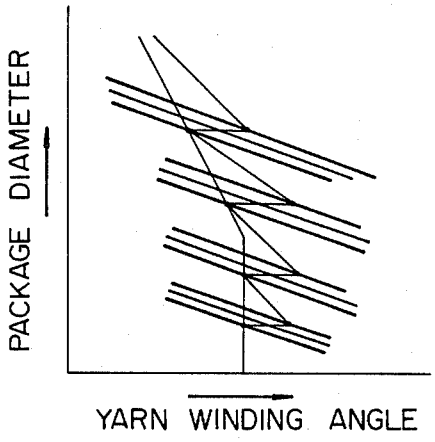
FIG. 13 shows a locus of the number of yarn traversing strokes obtained in accordance with another embodiment of the present invention, the lower limit value of the number of yarn traversing strokes being decreased on the way.
Figure 14:
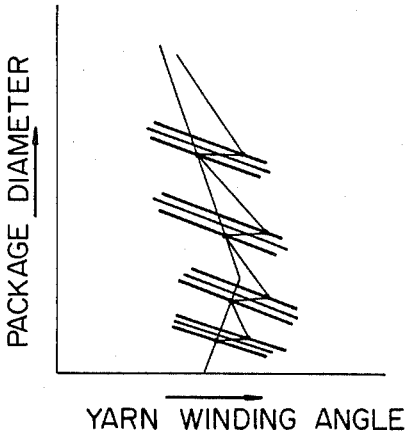
FIGS. 14 and 15 show loca of the number of yarn traversing strokes obtained in accordance with another embodiment of the present invention, the upper limit value of the number of yarn traversing strokes being decreased on the way.
Figure 15:
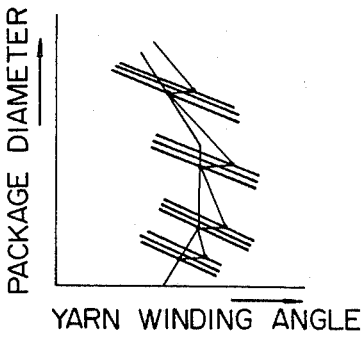

Furthermore, although it has been described that the lower limit value $\theta_L$ of the number of yarn traversing strokes is constant, it is noted that the upper limit value may be constant and the lower limit value varied as shown in FIG. 12 or each of the upper and lower limit values varied. It is also noted that the lower or upper limit values of the number of yarn traversing strokes may be decreased on the way as shown in FIGS. 13, 14 and 15.

Furthermore, although the motor 10 has been described as an induction motor and the number of rotations thereof picked up and fed back, it is noted that the motor 10 may also be an induction motor without a feedback control if the values of ribbon occurrence widths are slightly increased. Also, the motor 10 may be a synchronous motor without a feedback control.

What we claim is:

1. A method of winding a yarn on a bobbin holder so as to avoid a ribbonning phenomenon produced during winding, comprising the steps of:

rotating said bobbin holder;

traversing said yarn along an axis of said bobbin holder to form a yarn package on said bobbin holder;

setting a ribbon occurrence width and a lower limit value of a yarn winding angle at which said yarn is wound with respect to a vertical plane perpendicular to an axis of rotation of said bobbin holder;

calculating an upper limit value of said yarn winding angle from said lower limit value in such a manner that a winding ratio, which is defined as a ratio of the number of rotations of said bobbin holder to the number of yarn traversing strokes, is not within said ribbon occurrence width; and as soon as said winding ratio reaches said lower limit value of said yarn winding angle, increasing rapidly the number of yarn traversing strokes from said lower limit value of said yarn winding angle to said upper limit value, and then decreasing gradually the number of yarn traversing strokes from said upper limit value of said yarn winding angle to said lower limit value with a gradient larger than that of said winding ratio.

2. A machine for winding a yarn, comprising:

a bobbin holder on which said yarn is wound into a yarn package;

means for rotating said bobbin holder to wind said yarn thereon;

a traversing mechanism for traversing said yarn along an axis of rotation of said bobbin holder;

setting means for setting a ribbon occurrence width, a lower limit value of a yarn winding angle at which said yarn is wound with respect to a vertical plane perpendicular to said axis of rotation of said bobbin holder, and a traverse stroke of said yarn;

first detecting means for detecting a winding speed of said yarn;

gradient operation means for calculating the number of rotations of said bobbin holder from said lower limit value of said yarn winding angle, said traverse stroke and said winding speed of said yarn, for calculating an upper limit value of said yarn winding angle from said lower limit value of said yarn winding angle so that a winding ratio, which is defined as a ratio of the number of rotations of said bobbin holder to the number of yarn traversing strokes, is not within said ribbon occurrence width, for calculating the number of yarn traversing strokes from said upper limit value of said yarn winding angle, said traverse stroke and said winding speed, and for calculating a gradient of traverse from said number of yarn traversing strokes and said number of rotations of said bobbin holder, and for rapidly increasing the number of yarn traversing strokes from said lower limit value of said winding angle to said upper limit value, as soon as said winding ratio reaches said lower limit value, and then gradually decreasing the number of yarn traversing strokes from said upper limit value of said yarn winding angle to said lower limit value of said yarn winding angle with said gradient of traverse larger than that of said winding ratio;

second detecting means for detecting the number of rotations of said bobbin holder; and traverse operation means for calculating the number of yarn traversing strokes in accordance with said gradient of traverse calculated by said gradient operation means, said number of rotations of said bobbin holder calculated by said gradient operation means, and said number of rotations of said bobbin holder detected by said second detecting means, said yarn being traversed by said traversing mechanism in accordance with said number of yarn traversing strokes calculated by said traverse operation means.

3. A method of winding a yarn on a bobbin holder so as to avoid a ribbonning phenomenon produced during winding, comprising the steps of:

rotating said bobbin holder:

traversing said yarn along an axis of said bobbin holder to form a yarn package on said bobbin holder;

setting a ribbon occurrence width and an upper limit value of a yarn winding angle, at which said yarn is wound with respect to a vertical plane perpendicular to an axis of rotation of said bobbin holder;

calculating a lower limit value of said yarn winding angle from said upper limit value in such a manner that a winding ratio, which is defined as a ratio of the nunmber of rotations of said bobbin holder to the number of yarn traversing strokes, is not within said ribbon occurrence width; and as soon as said winding ratio reaches said lower limit value of said yarn winding angle, increasing rapidly the number of yarn traversing strokes from said lower limit value of said yard winding angle to said upper limit value, and then decreasing gradually the number of yarn traversing strokes from said upper limit value of said yarn winding angle to said lower limit value with a gradient larger than that of said winding ratio.

4. A machine for winding a yarn, comprising:

a bobbin holder on which said yarn is wound into a yarn package;

means for rotating said bobbin holder to wind said yarn thereon;

a traversing mechanism for traversing said yarn along an axis of rotation of said bobbin holder;

setting means for setting a ribbon occurrence width, an upper limit value of a yarn winding angle at which said yarn is wound with respect to a vertical plane perpendicular to said axis of rotation of said bobbin holder, and a traverse stroke of said yarn;

first detecting means for detecting a winding speed of said yarn;

gradient operation means for calculating the number of rotations of said bobbin holder from said upper limit value of said yarn winding angle, said traverse stroke and said winding speed of said yarn, for calculating a lower limit value of said yarn winding angle from said upper limit value of said yarn winding angle so that a winding ratio, which is defined as a ratio of the number of rotations of said bobbin holder to the number of yarn traversing strokes, is not within said ribbon occurrence width, for calculating the number of yarn traversing stokes from said lower limit value of said yarn winding angle, said traverse stoke and said winding speed, and for calculating a gradient of traverse from said number of yarn traversing strokes and said number of rotations of said bobbin holder, and for rapidly increasing the number of yarn traversing strokes from said lower limit value of said winding angle to said upper limit value, as soon as said winding ratio reaches said lower limit value, and then gradually decreasing the number of yarn traversing strokes from said upper limit value of said yarn winding angle to said lower limit value of said yarn winding angle with said gradient of traverse larger than that of said winding ratio;

second detecting means for detecting the number of rotations of said bobbin holder; and traverse operation means for calculating the number of yarn traversing strokes in accordance with said gradient of traverse calculated by said gradient operation means, said number of rotations of said bobbin holder calculated by said gradient operation means, and said number of rotations of said bobbin holder detected by said second detecting means, said yarn being traversed by said traversing mechanism in accordance with said number of yarn traversing strokes calculated by said traverse operation means.

* * * * *